US005104334A

United States Patent [19]

Honma et al.

[11] Patent Number: 5,104,334

[45] Date of Patent: Apr. 14, 1992

[54] LOCK PIECE MOUNTING STRUCTURE ON CONNECTOR HOOD

[75] Inventors: Naohiko Honma; Shoichi Hamano, both of Tokyo, Japan

[73] Assignee: Daiichi Denshi Kogyo Kabushiki Kaisha, Japan

[21] Appl. No.: 685,605

[22] Filed: Apr. 15, 1991

[30] Foreign Application Priority Data

Apr. 18, 1990 [JP] Japan ..... 2-41205

[51] Int. Cl.[5] ..... H01R 13/627

[52] U.S. Cl. ..... 439/357; 439/358

[58] Field of Search ..... 439/357, 358, 610, 563, 439/569, 570, 545, 538

[56] References Cited

U.S. PATENT DOCUMENTS

| | | | |
|---|---|---|---|
| 2,621,226 | 12/1952 | Conron et al. | 439/314 |
| 2,972,676 | 2/1961 | Moser | 439/314 |
| 4,352,538 | 10/1982 | Fowler | 439/538 |
| 4,389,021 | 6/1983 | Coldren | 439/545 |
| 4,797,123 | 1/1989 | Weber | 439/717 |
| 4,936,793 | 6/1990 | Uchida | 439/357 |
| 4,961,711 | 10/1990 | Fujiura et al. | 439/357 |
| 5,011,424 | 4/1991 | Simmons | 439/357 |

FOREIGN PATENT DOCUMENTS 0821853 10/1959 United Kingdom ..... 439/563

*Primary Examiner*—David I. Pirlot
*Assistant Examiner*—Hien D. Vu
*Attorney, Agent, or Firm*—Silverman, Cass & Singer, Ltd.

[57] ABSTRACT

A mounting structure of lock pieces on a connector hood includes L-shaped lock piece support portions projecting from side surfaces of the connector hood and having free ends rising upwardly, respectively, and L-shaped window portions provided in the lock pieces and having provisional window portions and complete window portions, respectively. Each of the provisional window portions has a width for receiving one of the L-shaped lock piece support portions and a height much more than a thickness of the L-shaped lock piece support portion. On the other hand, each of the complete window portions is continuous to the provisional window portion at its upper end and has a width and a height somewhat more than the width and the thickness of the L-shaped lock piece support portion, respectively. With this arrangement, the lock pieces are able to be mounted on the metal hood by once inserting the lock pieces into the provisional window portions, respectively, and then moving the lock pieces into the complete window portions of the lock pieces.

3 Claims, 2 Drawing Sheets

LOCK PIECE MOUNTING STRUCTURE ON CONNECTOR HOOD

BACKGROUND OF THE INVENTION

This invention relates to a lock piece mounting structure on a connector hood, and more particularly to a simplification of lock piece mounting structure on a connector hood.

In order to shield connectors from external noise signals, there have been many shielding methods. For example, as shown in FIG. 1, a male connector 1 is accommodated in a metal hood 2 and grounded or earthed through a shield cable 3 connected to the male connector 1 so that the male connector 1 is shielded together with a female connector 4 connected to the male connector 1.

With such a connector having the metal hood 2, it is still required to prevent the male and female connectors from being disconnected inadvertently owing to external force. For this purpose, as shown in FIG. 1 the metal hood 2 is provided on both sides with lock pieces 5 made of a springy metal plate. Each of the lock pieces 5 is provided at its upper end with a lock spring piece 5*a* formed by folding the upper end upon it and at the lower end with a lock hook 5*b*. The lock spring pieces 5*a* exert spring forces upon surfaces of the metal hood 2 so that the lock hooks 5*b* are anchored onto the female connector 4. Consequently, the male connector 1 is locked to the female connector 4 fixed to a panel and the like. Reference numeral 5*c* denotes urging portions which are provided at opposite portions of the lock spring pieces 5*a* by means of a resin molding.

However, the hitherto used mounting structure for the lock pieces 5 above described is difficult to manufacture and assemble. In more detail, the lock pieces 5 are mounted on the metal hood 2 in the following manner. The metal hood 2 is formed with pin-through holes 2*a* by cutting, raising and rounding parts of the side surfaces of the metal hood 2 as shown in a perspective view of FIG. 2*a*. On the other hand, the lock pieces 5 are formed at central narrow portions with semicircular curved support portions 5*d* as shown in FIG. 2*b*. The support portions 5*d* are then positioned at center notches 2*a*' between the pin-through holes 2*a* of the metal hood 2 and support pins 6 are inserted through the pin-through holes 2*a* as shown in FIG. 2*c*. These operations are complicated and troublesome for manufacturers.

As the pin-through holes 2*a* of the metal hood 2 are very small, the cutting, raising and rounding of the parts of the metal hood 2 are very difficult, and at the same time as diameters of the semicircular curved support portions 5*d* of the lock pieces 5 are also small, the bending of the curved support portions 5*d* is difficult. In addition thereto, the positioning of the support portions 5*d* at the center notches 2*a*' between the pin-through holes 2*a* is also very difficult because the lock pieces 5 are subjected to force produced by the lock spring pieces 5*a* tending to expel the lock pieces 5 from the center notches 2*a*' in a direction shown by the arrow in FIG. 2*c*. What is worse still, the insertion of the fine and small pins 7 into the pin-through holes 2*a* is also very difficult. Therefore, the production cost of this hitherto used structure unavoidably increases.

SUMMARY OF THE INVENTION

It is an object of the invention to provide an improved mounting structure of lock pieces on a connector hood, which eliminates all the disadvantages of the prior art and is relatively simple and inexpensive to manufacture, easy to assemble and rugged and durable in use.

In order to accomplish this object, the mounting structure of lock pieces on a connector hood according to the invention comprises L-shaped lock piece support portions projecting from side surfaces of the connector hood and having free ends rising upwardly, respectively, and L-shaped window portions provided in the lock pieces and having provisional window portions and complete window portions, respectively, each of the provisional window portions having a width for receiving a width of one of the L-shaped lock piece support portions and a height much more than a thickness of the L-shaped lock piece support portion, and each of the complete window portions continuous to the provisional window portion at its upper end and having a width and a height somewhat more than the width and the thickness of the L-shaped lock piece support portion, respectively, thereby enabling the lock pieces to be mounted on the metal hood by once inserting the lock pieces into the provisional window portions and then moving the lock pieces into the complete window portions of the lock pieces.

In a preferred embodiment of the invention, each of the lock piece support portions is located shifted relative to the width of the hood so that one of the side edges thereof is positioned substantially at a width center of the metal hood, and each of the L-shaped window portions is located substantially at a width center of the lock piece. In this case, it is preferable that the lock piece support portions are located in point symmetry with respect to a center axis of the metal hood.

The invention will be more fully understood by referring to the following detailed specification and claims taken in connection with the appended drawings.

DESCRIPTION OF THE PREFERRED EMBODIMENTS

Figure 1:
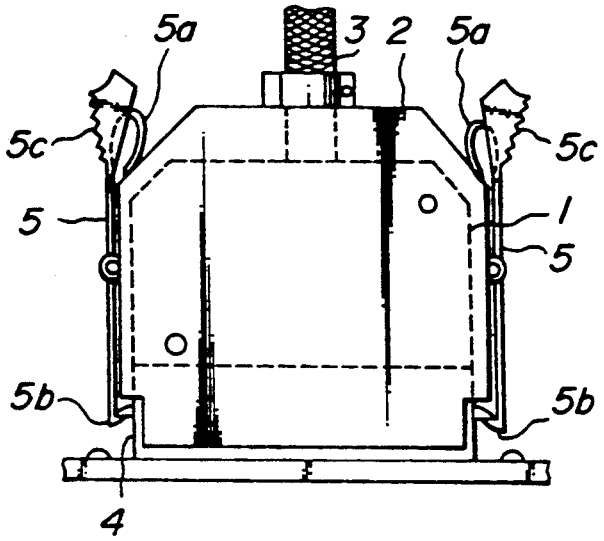
FIG 1 PRIOR ART
FIGS. 1 and 2*a*, 2*b* and 2*c* are explanatory views of a mounting structure of lock pieces on a connector hood of the prior art which had been explained in the foregoing.
Figure 2A:
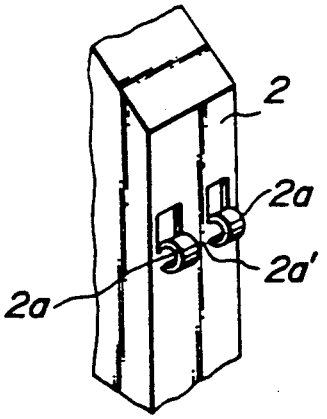
FIG 2a PRIOR ART
Figure 2B:
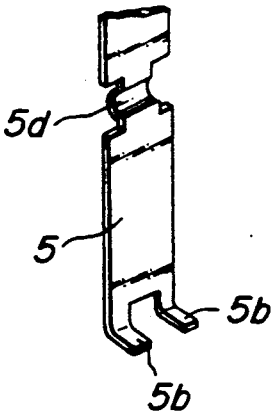
FIG 2b PRIOR ART
Figure 2C:
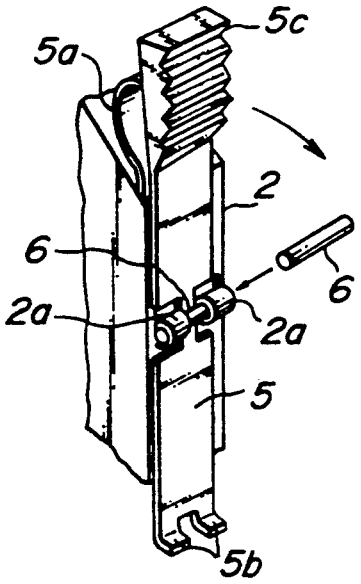
FIG 2c PRIOR ART
Figure 3A:
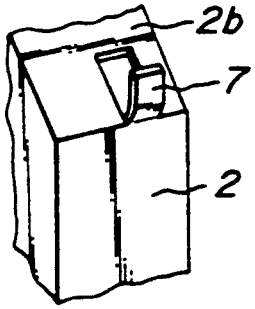
FIGS. 3*a* and 3*b* and 4*a* to 4*d* are explanatory views of one embodiment of the structure according to the invention.
Figure 3B:
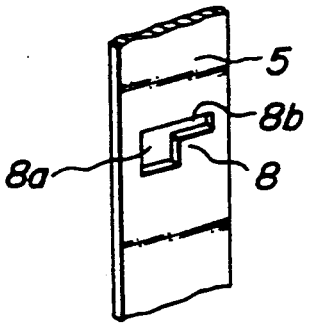

FIGS. 3*a* and 3*b* illustrate in partial perspective views one embodiment of the mounting structure according to the invention. The invention is characterized by the following two features.

(1) Side surfaces, for example, oblique surfaces 2*b* of shoulders of a metal hood 2 are cut and raised away from the oblique surfaces 2*b* to form L-shaped lock piece support portions 7 whose lower ends are still connected to the metal hood 2 and free ends face upwardly.

(b 2) Lock pieces 5 are formed in the proximity of centers with L-shaped window portions 8. Each of the window portions 8 is composed of a provisional window portion 8a and a complete window portion 8b continuous to and located laterally of the upper portion of the provisional window portion 8a. The provisional window portion 8a has a width somewhat more than the width of the L-shaped lock piece support portion 7 and a height much more than the thickness of the lock piece support portion 7. On the other hand, the complete window portion 8b has a width substantially equal to the width of the L-shaped lock piece support portion 7 and a height somewhat more than the thickness of the lock piece support portion 7.

Figure 4A:
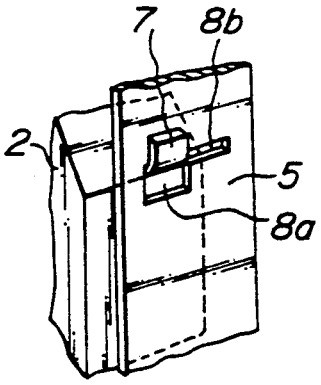
Figure 4B:
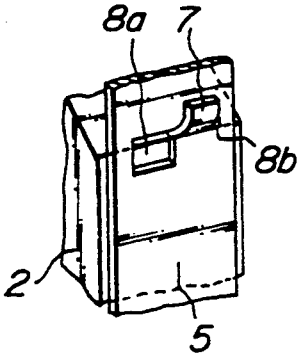

With this particular construction, first the L-shaped lock piece support portion 7 of the metal hood 2 is inserted into the provisional window portion 8a of the lock piece 5 as shown in FIG. 4a. Thereafter, the lock piece 5 is lowered until the lock piece support portion 7 of the metal hood 2 abuts against the upper edge of the provisional window portion 8a, and then the lock piece 5 is moved laterally so that the L-shaped lock piece support portion 7 is inserted into the complete window portion 8b until the lock piece support portion 7 abuts against the side edge of the complete window portion 8b remote from the provisional window portion 8a as shown in FIG. 4b. The same holds true in mounting the other lock piece 5 onto the metal hood 2. The lock pieces 5 on both sides are completely held by the metal hood 2 in this manner.

Figure 4C:
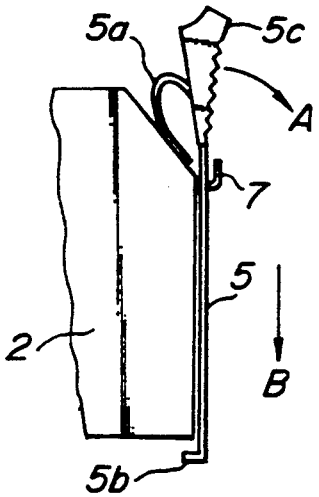

In the case that the lock pieces 5 are provided with lock spring pieces 5a exerting spring forces upon the oblique surfaces of the metal hood 2 as shown in a partial front view of FIG. 4c, the lock pieces 5 are urged in a direction shown by an arrow A, with the result that the upper edges of the complete window portions 8b abut against the lock piece support portions 7. Therefore, the lock pieces 5 are securely held by the metal hood 2 without removing from the L-shaped lock piece support portions 7.

FIGS. 3a and 3b and FIGS. 4a–4c illustrate one example including the metal hood having a width of 35 mm, a height of 20 mm and a thickness of 10 mm and the oblique surfaces of shoulders inclined at approximately 50°.

Parts of the oblique surfaces of the shoulders of the metal hood 2 are cut and raised so that the lock piece support portions 7 project from corners at lower ends of the oblique surfaces of the shoulders of the hood 2. The lock piece support portions 7 have widths of 2 mm and overall lengths of 2 mm and are curved in L-shapes whose free ends face substantially upwardly. Their thicknesses are 0.5 mm which are equal to the thickness of the metal hood 2.

Figure 4D:
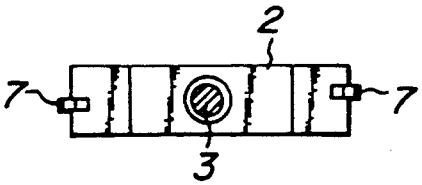

Each of the lock piece support portions 7 is located such that one side edge is substantially at a center of the oblique surface of the shoulder or slightly shifted to the thickness direction of the hood 2. With this arrangement, the L-shaped window portion 8 formed in the lock piece 5 is naturally positioned substantially at the center of the lock piece 5, which is advantageous. In this case, it is very preferable in assembling that the lock piece support portions 7 on both sides are shifted in reverse directions or located in point symmetry with respect to a center axis of the metal hood 2 as shown in FIG. 4d so that the lock pieces 5 on both sides are quite the same in configuration.

Each of the lock pieces 5 has an overall length of 30 mm and is provided at one end with a lock hook 5b and at the other end with an urging portion 5c made of a resin fixed thereto. The lock piece 5 is made of a stainless steel having a thickness of about 0.25 mm except the urging portion 5c and a width of 9 mm. The lock spring piece 5a is formed by bending a part somewhat narrower than and extending from one end of the stainless steel.

The provisional window portion 8a is a rectangular aperture having a width of about 2.2 mm extending from the center of the width of the lock piece 5 and a height of about 1.5 mm. On the other hand, the complete window portion 8b is also a long rectangular aperture having a width of 2 mm from the center of the width of the lock piece 5 in the opposite direction to the provisional window portion 8a and a height of about 0.6 mm. These rectangular apertures 8a and 8b are continuous to each other to form the L-shaped window portion 8.

The position of the L-shaped window portion 8 relative to the overall length of the lock piece 5 is inevitably determined by a distance between the lock hook 5b and the lock piece support portion 7 previously determined by a relation with a mating connector (not shown).

Figure 5:
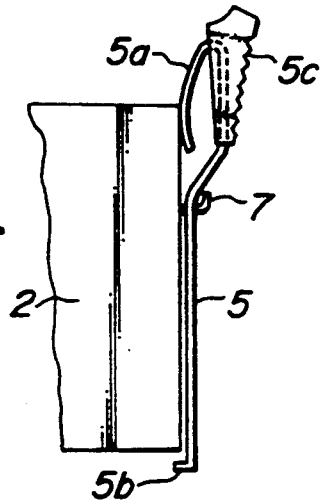
FIG. 5 is an explanatory view of another embodiment of the invention.

FIG. 5 illustrates another embodiment of the invention. In this embodiment, lock piece support portions 7 project from flat side walls of a hood 2 not having oblique surfaces at both shoulders of the hood 2 of the first embodiment shown in FIGS. 3a and 3b and FIGS. 4a–4c.

In this embodiment, part of the lock piece 5 which is anchored to the lock piece support portion 7 or formed with the L-shaped window portion 8 is so bent that the urging portion 5c is spaced from the hood 2. In order to obtain the same effect as that of the first embodiment shown in FIGS. 3a and 3b and FIGS. 4a to 4c, the angle of the bent of the lock piece 5 is preferably of the order of 40° to 60° relative to the side wall of the hood 2 and other conditions the same as those in the first embodiment may be adopted.

As can be seen from the above description, lock pieces can be held on the metal hood by inserting the L-shaped lock piece support portions into the L-shaped window portions according to the invention with the following advantages. It is not needed to provide pin-through holes of the metal hood and semicircular curved support portions of the lock pieces which are difficult to be worked. Moreover, according to the invention the positioning of the lock pieces relative to the metal hood is readily carried out without requiring difficult insertion of pins into the pin-through holes which would be needed in the prior art. Further, as pins are not used, the number of parts can be reduced.

While the invention has been particularly shown and described with reference to preferred embodiments thereof, it will be understood by those skilled in the art that the foregoing and other changes in form and details can be made therein without departing from the spirit and scope of the invention.

What is claimed is:

1. A mounting structure of lock pieces on a connector hood comprising, L-shaped lock piece support portions projecting from side surfaces of the connector hood and having free ends protruding therefrom, and L-shaped window portions provided in the lock pieces and having provisional window portions and complete window portions respectively, each of the provisional window portions having a width for receiving a width of one of the L-shaped lock piece support portions and a height greater than a thickness of the L-shaped lock piece support portion, and each of the complete window portions being continuous to the provisional window portion at its upper end and having a width and a height greater than the width and the thickness of the L-shaped lock piece support portion respectively, thereby enabling the lock pieces to be mounted into the provisional window portions and then moving the lock pieces into the complete window portions of the lock pieces.

2. A mounting structure of lock pieces on a connector hood as claimed in claim 1, wherein each of the L-shaped lock piece support portions is located so that one of the side edges thereof is positioned substantially at a center of the connector hood on a side portion thereof, and each of the L-shaped window portions is located so that the boundary of the associated provisional window portion and the complete window portion is located substantially at said center of the connector hood.

3. A mounting structure of lock pieces on a connector hood as claimed in claim 2, wherein the L-shaped lock piece support portions are arranged in rotational symmetrically with respect to a center line of the metal hood.

* * * * *

UNITED STATES PATENT AND TRADEMARK OFFICE

CERTIFICATE OF CORRECTION

PATENT NO. : 5,104,334

DATED : April 14, 1992

INVENTOR(S) : Naohiko Honma and Shoichi Hamano

It is certified that error appears in the above-identified patent and that said Letters Patent is hereby corrected as shown below:

Column 2, line 66, change "(b2)" to --(2)--;

Column 5, line 5, after "mounted" insert --on the connector hood by first inserting the lock pieces--.

Signed and Sealed this

Fourteenth Day of September, 1993

Bruce Lehman

*Attest:*

BRUCE LEHMAN

*Attesting Officer*

*Commissioner of Patents and Trademarks*